US009811039B2

(12) United States Patent
Suzuki et al.

(10) Patent No.: US 9,811,039 B2
(45) Date of Patent: Nov. 7, 2017

(54) IMAGE FORMING APPARATUS USING PRESSING PLATE AND COMPUTER-READABLE MEDIUM STORING INSTRUCTIONS TO CONTROL MOVEMENT OF PRESSING PLATE

(71) Applicant: BROTHER KOGYO KABUSHIKI KAISHA, Nagoya, Aichi (JP)

(72) Inventors: Takashi Suzuki, Aichi (JP); Masahito Saeki, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 49 days.

(21) Appl. No.: 15/080,665

(22) Filed: Mar. 25, 2016

(65) Prior Publication Data

US 2016/0282778 A1 Sep. 29, 2016

(30) Foreign Application Priority Data

Mar. 27, 2015 (JP) ..... 2015-067106

(51) Int. Cl.
*G03G 15/00* (2006.01)
*G03G 15/20* (2006.01)

(52) U.S. Cl.
CPC ..... *G03G 15/6502* (2013.01); *G03G 15/65* (2013.01); *G03G 15/2039* (2013.01); *G03G 2215/00383* (2013.01); *G03G 2215/00603* (2013.01)

(58) Field of Classification Search
CPC ..... G03G 15/2039; G03G 15/6502; G03G 2215/00603; G03G 2215/00383; G03G 15/65
See application file for complete search history.

(56) References Cited

U.S. PATENT DOCUMENTS

2004/0136744 A1 7/2004 Endo
2005/0042005 A1* 2/2005 Imai ..... G03G 15/6567 399/371
2005/0218584 A1 10/2005 Dan

FOREIGN PATENT DOCUMENTS

JP H07-61611 A 3/1995
JP 2004-163758 A 6/2004
JP 2005-292456 A 10/2005
JP 2007-091360 A 4/2007

* cited by examiner

*Primary Examiner* — David M Gray
*Assistant Examiner* — Andrew V Do
(74) *Attorney, Agent, or Firm* — Scully, Scott, Murphy & Presser, PC

(57) ABSTRACT

An electrophotographic image forming apparatus has a controller configured to store a rotation amount of a motor since the tray is attached to a main body of the image forming apparatus as a stored rotation amount, and move, in response to receipt of a print instruction, a pressing plate by driving the motor in the first mode when a remaining rotation amount is equal to or larger than a particular threshold rotation amount, the remaining rotation amount being a difference between a target rotation amount which is a rotation amount necessary to move the pressing plate from a position when the tray is attached to the main body to the conveying position, and the stored rotation amount, or in the second mode when the remaining rotation amount is less than the particular threshold rotation amount.

12 Claims, 9 Drawing Sheets

IMAGE FORMING APPARATUS USING PRESSING PLATE AND COMPUTER-READABLE MEDIUM STORING INSTRUCTIONS TO CONTROL MOVEMENT OF PRESSING PLATE

CROSS-REFERENCE TO RELATED APPLICATION

This application claims priority under 35 U.S.C. §119 from Japanese Patent Application No. 2015-067106 filed on Mar. 27, 2015. The entire subject matter of the application is incorporated herein by reference.

BACKGROUND

Technical Field

The present disclosures relate to an image forming apparatus configured to form an image on a printing sheet in accordance with an electrophotographic image forming method. Further, the present disclosures relate to the image forming apparatus using a liftable pressing plate, which is controlled to move up and down, for a sheet feed tray. Furthermore, the present disclosures also relate to a method of controlling such a pressing plate, and a non-transitory computer readable medium storing instructions to realize such a method.

Related Art

Conventionally, there has been known an electrophotographic image forming apparatus using a pressing plate configured to move up the printing sheets accommodated in the sheet feed tray to a conveying position at which the printing sheets can be fed inside the image forming apparatus. Typically, the pressing plate is configured to be moved up by a driving formed supplied from a main motor. In such an image forming apparatus, immediately after the sheet feed tray is set to a main body of the image forming apparatus, the main motor is rotated to move up the pressing plate, a printing operation can be started quickly.

Generally, the main motor of the image forming apparatus is also mechanically connected to consumable components including photosensitive drums, fixing rollers, a developing roller, and the driving force of the main motor is transmitted to such consumable components. Because of such a configuration, when the main motor is rotated to move up the pressing plate, the other consumable components are also rotated, which may shorten the life of the consumable components.

SUMMARY

As mentioned above, since the main motor serves as a driving source of the consumable components, it is not preferable to rotate the main motor only for moving the pressing plate. The pressing plate may be moved when a print instruction is received. However, if the main motor is rotated at a relatively high speed to move the pressing plate quickly so that printing could be started quickly, relatively loud noise may be generated. If the main motor is rotated at a relatively slow speed, although the noise may be suppressed, movement of the pressing plate may take time and start of printing may be delayed.

In consideration of the foregoing, aspects of the present disclosures provide an improved image forming apparatus, which uses the pressing plate driven by the main motor, and a suitable control of the main motor is available.

According to aspects of the disclosures, there is provided an electrophotographic image forming apparatus, which has a motor, an image forming device configured to form an image on a printing sheet, the image forming device using a driving force transmitted from the motor, a fixing device configure to fix the image formed on the printing sheet, a tray configured to accommodate multiple printing sheets to be conveyed toward the image forming device, the tray being detachably attached to a main body of the image forming apparatus, a pressing plate configured to move up, with use of a driving force of the motor, the printing sheets accommodated in the tray to a conveying position, a storage device and a controller. The motor is configured to operable in a first mode in which the motor rotates at a first speed and a second mode in which the motor rotate at a second speed which is slower than the first speed. The controller is configured to execute a storing process in which the controller stores a rotation amount of the motor since the tray is attached to the main body as a stored rotation amount, and a moving process in which the controller moves, in response to receipt of a print instruction, the pressing plate by driving the motor such that the controller drives the motor in the first mode when a remaining rotation amount is equal to or larger than a particular threshold rotation amount, the remaining rotation amount being a difference between a target rotation amount, which is a rotation amount necessary to move the pressing plate from a position when the tray is attached to the main body to the conveying position, and the stored rotation amount, which is stored in the storage device, and the controller drives the motor in the second mode when the remaining rotation amount is less than the particular threshold rotation amount.

According to aspects of the disclosures, there is also provided a non-transitory computer-readable medium storing instructions to be executed by a controller of an image forming apparatus provided with a motor, an image forming device configured to form an image on a printing sheet, the image forming device using a driving force transmitted from the motor, a fixing device configure to fix the image formed on the printing sheet, a tray configured to accommodate multiple printing sheets to be conveyed toward the image forming device, the tray being detachably attached to a main body of the image forming apparatus, a pressing plate configured to move up, with use of a driving force of the motor, the printing sheets accommodated in the tray to a conveying position, a data storage device, wherein the motor is configured to operable in a first mode in which the motor rotates at a first speed and a second mode in which the motor rotate at a second speed which is slower than the first speed. The instructions, when executed by the controller, cause the image forming apparatus to execute a storing process in which the controller stores a rotation amount of the motor since the tray is attached to the main body as a stored rotation amount, a moving process in which the controller moves, in response to receipt of a print instruction, the pressing plate by driving the motor such that the controller drives the motor in the first mode when a remaining rotation amount is equal to or larger than a particular threshold rotation amount, the remaining rotation amount being a difference between a target rotation amount, which is a rotation amount necessary to move the pressing plate from a position when the tray is attached to the main body to the conveying position, and the stored rotation amount, which is stored in the data storage device, and the controller drives the motor in the second mode when the remaining rotation amount is less than the particular threshold rotation amount.

According to aspects of the disclosures, there is further provided a method of controlling movement of a pressing plate used in an image forming apparatus which is provided with a motor, an image forming device configured to form an image on a printing sheet, the image forming device using a driving force transmitted from the motor, a fixing device configure to fix the image formed on the printing sheet, a tray configured to accommodate multiple printing sheets to be conveyed toward the image forming device, the tray being detachably attached to a main body of the image forming apparatus, a pressing plate configured to move up, with use of a driving force of the motor, the printing sheets accommodated in the tray to a conveying position, and a data storage device, the motor being configured to operable in a first mode in which the motor rotates at a first speed and a second mode in which the motor rotate at a second speed which is slower than the first speed. The method includes a storing step to store a rotation amount of the motor since the tray is attached to the main body as a stored rotation amount, a moving step to move, in response to receipt of a print instruction, the pressing plate by driving the motor in the first mode when a remaining rotation amount is equal to or larger than a particular threshold rotation amount, the remaining rotation amount being a difference between a target rotation amount, which is a rotation amount necessary to move the pressing plate from a position when the tray is attached to the main body to the conveying position, and the stored rotation amount, which is stored in the storage device, and in the second mode when the remaining rotation amount is less than the particular threshold rotation amount.

BRIEF DESCRIPTION OF ACCOMPANYING DRAWINGS

FIG. 1 schematically illustrates a configuration of a printer according to an illustrative embodiment of the disclosures.

DESCRIPTION OF ILLUSTRATIVE EMBODIMENT

Hereinafter, referring to the accompanying drawings, a printer according to an illustrative embodiment of the disclosures will be described.

<Inside Configuration of Printer>

Figure 1:
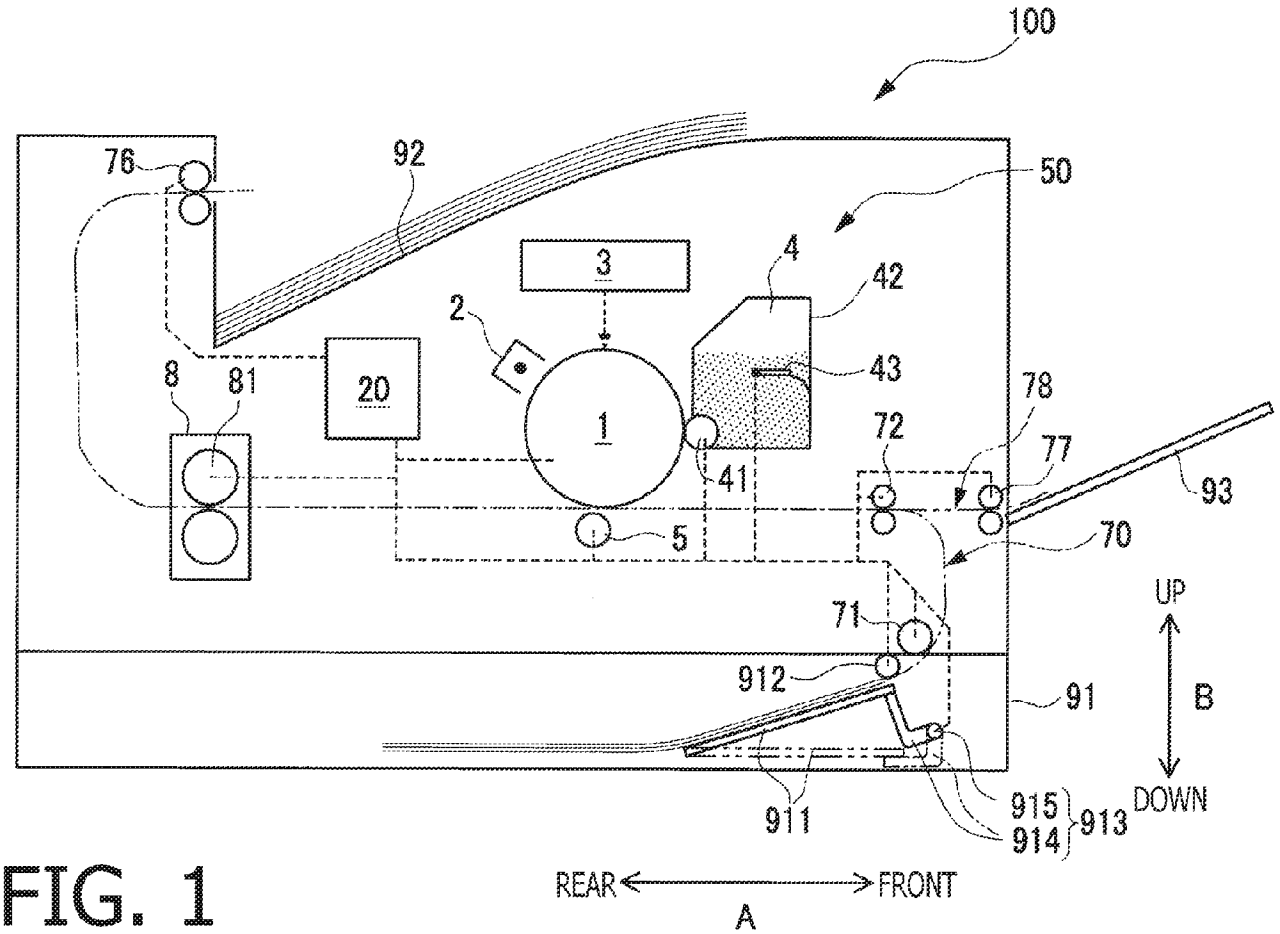

A printer 100 according to an illustrative embodiment is configured to print an image on a printing sheet according to an electrophotographic imaging method. As shown in FIG. 1, the printer 100 has a processing device 50, which functions to form a toner image and transfer the toner image on the printing sheet, a fixing device 8, which applies heat and pressure to permanently fix the transferred toner image on the printing sheet, a main body tray 91, which accommodates printing sheets to be conveyed to the processing device 50, an MP tray (multi-purpose tray) 93, a discharge tray 92, which receives and accommodates the printing sheets conveyed from the processing device 50, an a motor 20, which serves as a driving source for rotating members of the printer 100. The fixing device 8 has a fixing roller 81 having a built-in heater. Various types of motors may be used as the motor 20, and according to the illustrative embodiment, a DC brushless motor is used, for example. It is noted that the processing unit 50 is an example of an image forming device, and the fixing device 8 is an example of a fixing device set forth in the claims. Further, the main body tray 91 is an example of a tray, and the MP tray 93 is an example of a second try set forth in the claims.

Inside the printer 100, a conveying passage 70 (indicated by a dotted line in FIG. 1) is defined. The conveying passage 70 is substantially S-shaped when viewed from a side (i.e., in a direction perpendicular to a plane of FIG. 1). The conveying passage 70 is configured to guide the printing sheets accommodated in the main body tray 91, which is arranged at a bottom part of the printer 10, from the main body tray 91 to the discharge tray 92, which is arrange at an upper part of the printer 100, via a sheet feed roller 71, a registration roller 72, the processing device 50, the fixing device 8 and a discharging roller 76.

Further, inside the printer 100, another conveying passage 78 (indicated by two-dotted line in FIG. 1) is also defined. The conveying passage 78 is configured to guide the printing sheet accommodated in the MP tray 93, which is arranged on a front side of the printer 100, to join the conveying passage 70 at a position before (i.e., on the front side of) the registration roller 72 via a sheet feed roller 77. Each of rotating bodies such as the sheet feed roller 71, the registration roller 72, the fixing roller 81, the discharging roller 76, the sheet feed roller 77 rotates as a rotating force is transmitted from the motor 20.

The process device 50 has a drum-like photosensitive member 1, a charging device 2 configured to charge the circumferential surface of the photosensitive member 1, an exposing device 3 configured to emit light to the processing device 50, a developing device 4 configured to supply toner to the photosensitive member 1, and a transfer roller 5 configured to transfer the toner on the photosensitive member 1 onto the printing sheet. The developing device 4 has a developing roller 41 configured to supply the toner onto the photosensitive member 1, a toner tank 42 configured to accommodate the toner, and an agitator 43 configured to agitate the toner inside the toner tank 42. Each of the rotating members including the photosensitive member 1, the developing roller 41, the agitator 43, the transfer roller 5 is mechanically connected to the motor 20, and rotates as the rotating force of the motor 20 is transmitted. It is noted that the toner tank 42 is an example of a toner accommodator and the agitator 43 is an example of an agitator set forth in the claims.

In the processing device 50, the circumferential surface of the photosensitive member 1 is uniformly charged by the charging device 2. Thereafter, the charged surface of the photosensitive member 1 is exposed to the light emitted from the exposing device 3, thereby an electrostatic latent image corresponding to an image to be formed on the printing sheet is formed on the circumferential surface of the photosensitive member 1. Next, via the developing device 4, the toner is supplied to the photosensitive member 1. Then, the toner is attracted onto the circumferential surface of the photosensitive member 1 according to the electrostatic latent image, thereby the electrostatic latent image being developed and a toner image being formed.

When the printer 100 receives a print instruction requiring that the printing sheet is fed from the main body tray 91, the printer 100 picks up the printing sheets accommodated in the main body tray 91 one by one, which is conveyed to the processing device 50 via the sheet feed roller 71 and the registration roller 72.

When the printer 100 receives a print instruction requiring that the printing sheet is fed from the MP tray 93, the printer 100 picks up the printing sheets placed on the MP tray 93 one by one, which is conveyed to the printing sheet to the processing device 50 via the sheet feed roller 77 and the registration roller 72.

Then, the toner image formed in the processing device 50 is transferred from the photosensitive member 1 to the thus conveyed printing sheet. Thereafter, the printing sheet, on which the toner image is transferred, is conveyed to the fixing device 8. The fixing device 8 heat-fixes the toner image on the printing sheet. Thereafter, the printing sheet is discharged onto the discharge tray 92 via the fixing roller 81 and the discharging roller 76.

The main body tray 91 is slidably movable, with respect to a main body of the printer 100, in a front-rear direction (i.e., in a direction indicated by arrow A in FIG. 1), and detachably attached to the printer 100. Inside the main body tray 91, a pressing plate 911 configured to move up the printing sheets accommodated inside the main body tray 91, a pickup roller 912 configured to picks up the uppermost sheet of the printing sheets which are stacked on the main body tray 91 and feeds the same toward the conveying passage 70, and a lifting mechanism 913 configured to move up/down a front end of the pressing plate 911 in the up-down direction (i.e., in a direction indicated by arrow 3 in FIG. 1).

The pressing plate 911 is configured such that a rear end portion, which is an end portion farther from the pickup roller 912, is rotatably supported and a front end portion which is an end portion closer to the pickup roller 912 is moved up and down by the lifting mechanism 913. In other words, the pressing plate 910 is movable between a placing position (indicated by two-dotted line in FIG. 1) at which the front end portion is located on the bottom wall of the main body tray 91 and spaced from the pickup roller 912 and a conveying position (indicated by slid line in FIG. 1) at which the pressing plate 912 is inclined such that the front end portion is lifted upward and located close to the pickup roller 912.

The lifting mechanism 913 is arranged on the front end side of the main body tray 91, and is provided with a lever 914 configured to move up the pressing plate 911. The lever 914 is formed to have an L-shaped cross section such that it extends, from the front end side of the pressing plate, around the lower side of the pressing plate 911. One end of the lever 914 is fixed to an shaft 915 arranged on the front end portion of the main body tray 91, and the other end of the lever 914 contacts a lower surface of the pressing plate 911. As the lever 914 rotates about the shaft 915, the other end of the lever 914 moves up the front end portion of the pressing plate 911. The shaft 915 is connected to the motor 20, and rotates as the driving force of the motor 20 is transmitted. That is, the pressing plate 911 moved up/down as the driving force of the motor 20 is transmitted to the shaft 915.

The front end portion of the pressing plate 911 is moved up by the lever 914, thereby the pressing plate 911 moving from the placing position to the conveying position. When the pressing plate 911 is located at the conveying position, the uppermost printing sheet on the pressing plate 911 is urged toward the pickup roller 912. When the pickup roller 912 is rotated with the pressing plate 911 being located at the conveying position, the uppermost printing sheet on the pressing plate 911 is picked up by the pickup roller 912. Then, the picked up printing sheet is conveyed toward the conveying passage 70 by the sheet feed roller 71. After the uppermost printing sheet is fed, the printer 100 moves up the pressing plate 911 so that the next printing sheet us urged to the pickup roller 912. That is, as the printing sheets are conveyed, the conveying position of the pressing plate 911 is gradually moves up. It is noted that the lifting mechanism 913 keeps the position of the pressing plate 911 after printing is completed.

When the main body tray 91 is detached from the main body of the printer 100, the lifting mechanism 913 is disengaged from the transmission mechanism that is configured to transmit the driving force of the main motor 20, thereby the position of the pressing plate 911 being maintained any more. As a result, the front end portion of the pressing plate 911 moves down by its own weight. Thus, the pressing plate 911 is located at the placing position. When the pressing plate 911 is located at the placing position, the user can place the printing sheets on the pressing plate 911.

<Electrical Configuration of Printer>

Figure 2:
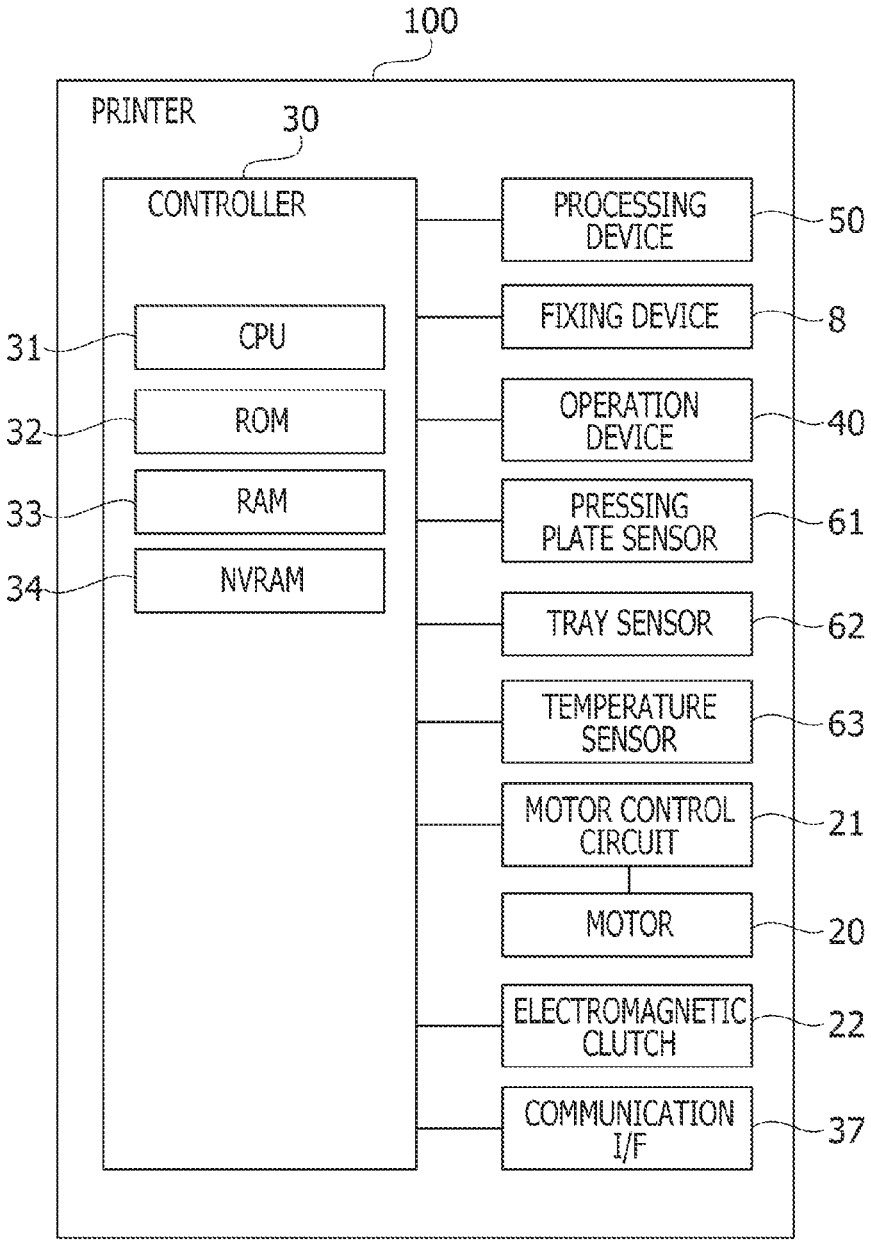
FIG. 2 is a block diagram showing an electric configuration of the image forming apparatus according to the illustrative embodiment of the disclosures.

As shown in FIG. 2, the printer 100 has a controller 30 which contains a CPU (central processing unit) 31, a ROM (read only memory) 32, a RAM (random access memory) 33, an NVRAM (non-volatile RAM) 34. Further, the printer 100 has the processing device 50, the fixing device 8, an operation device 40, a pressing plate sensor 61, a tray sensor 62, a temperature sensor 63, a motor driving circuit 21, an electromagnetic clutch 22, and a communication interface 37, which are controlled by the CPU 31. It is noted that the controller 30 is a collective term including hardware components (e.g., CPU 31) used to control the printer 100, and is not intended to mean a signal hardware component existing in the printer 100.

The ROM 32 stores firmware which is a control program to control the printer 100, setting values and initial values. The RAM 33 or the NVRAM 33 is used as a work area for control programs retrieved from the RAM 33 or NVRAM 34 and/or a storage area in which image data is temporarily stored. It is noted that the NVRAM 34 is an example of a storage device set forth in the claims.

The CPU 31 controls respective components of the printer 100 in accordance with the retrieved programs and signals transmitted from the respective sensors, with storing processing results in the RAM 33 or the NVRAM 34. It is noted that the CPU 31 is an example of the controller set forth in the claims. It is also noted that the controller 30 is the controller set forth in the claims.

The operation device 40 is provided on an outer surface of the printer 100. The operation device 40 has operation buttons for acquiring the user's input operations, and a touch panel configured to display messages and settings. It is noted that the buttons include, for example, an execution button to input a start instruction of an image processing, and a cancel button to input a cancellation instruction to cancel image processing. According to the illustrative embodiment, the operation device 40 is configured to acquire inputs which are input as the user touches his/her finger on the touch panel.

The pressing plate sensor 61 is arranged on the outer surface of the printer 100, and outputs different signals depending on whether the pressing plate 911 is located at the conveying position or not, under condition that the main body tray 91 is attached to the main body of the printer 100. The tray sensor 62 is arranged on the outer surface of the printer 100, and outputs a temperature signal corresponding to a surface temperature of the fixing roller 81.

The motor control circuit 21 includes a driver which switches power supplying status with respect to the motor 20, and controls a rotation speed of the motor 20 in accordance with an instruction by the CPU 31. According to the illustrative embodiment, the motor control circuit 21 is capable of switching the rotation speed of the motor 20 between a first speed and a second speed that is slower than the first speed, in accordance with the instruction by the CPU 31.

The electromagnetic clutch 22 is configured to connect/disconnect the driving force, which is transmitted through a drive array, electrically, and provided within a drive array from the motor 20 to a portion where the driving force of the motor 20 is transmitted to the shaft 915 of the lifting mechanism 913.

The communication interface 37 is hardware enabling a communication with another device. For example, as such a communication interface 37, a network interface, a serial communication interface, a parallel communication interface have been known. The printer 100 is capable of receiving image data subject to print from an external device through the communication interface 37.

<Lifting Control of Pressing Plate>

Next, a lifting control of the pressing plated will be described. According to the printer 100, an operation of the motor 20 is determined based on a rotation amount of the motor 20 after the main body tray 91 is attached to the printer 100, that is, depending on a lifting amount of the pressing plate 911. It is noted that, according to the illustrative embodiment, when only one printing sheet is accommodated in the main body tray 91, the pressing plate 911 is moved from the placing position (i.e., a position indicated by two-dotted line in FIG. 1) to the conveying position (i.e., a position indicated by solid line in FIG. 1).

According to the illustrative embodiment, when conveying the printing sheets from the main body tray 91 in accordance with the print job, it is necessary that the pressing plate 911 is located at the conveying position. For this purpose, when the pressing plate 911 is not located at the conveying position, the printer 100 rotates the motor 20 so that the lifting mechanism 913 moves up the pressing plate 911 to the conveying position.

For example, when conveying the printing sheets is to be started based on the printing job, if the pressing plate 911 is located at the placing position, that is, if the rotation amount of the motor 20 after the main body tray 91 is attached to the printer 100 is zero, the printer 100 sets a target rotation amount of the motor 20 to 200, controls the motor 20 to rotate at a relatively high speed so that the pressing plate 911 is moved to the conveying position quickly. If the pressing plate 911 is located at the conveying position, it is unnecessary to move the motor 20 to further lift the pressing plate 911. Accordingly, in this case, the motor 20 is driven to rotate based on preparation operations of other devices.

There could be a case where the pressing plate 911 is located at a position between the placing position and the conveying position when conveying of the printing sheets based on the print job is to be executed. For example, when the main body tray 91 has just been attached to the printer 100 and a print job in which the printing sheets are fed from the MP tray 93 is executed before the printing sheet is fed from the main body tray 91.

Figures 3A, 3B:
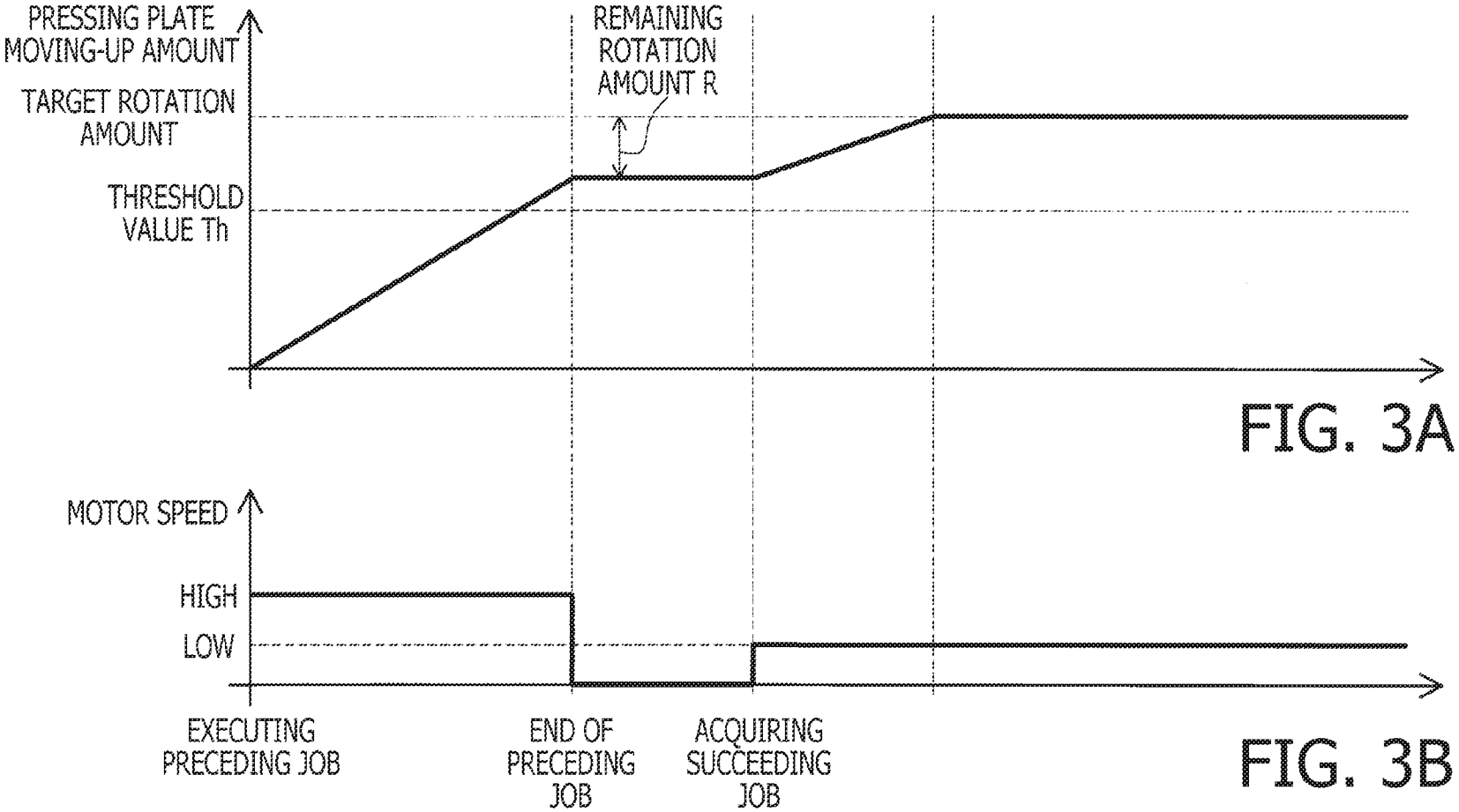
FIGS. 3A and 3B show a relationship between a position of a pressing plate and a speed of a motor when the position of the pressing plate is relatively low according to the illustrative embodiment of the disclosures.

Therefore, as shown in FIG. 3, the rotation amount of the motor 20 after the main body tray 91 is attached to the main body of the printer 100 is greater than a threshold value Th. That is, when a remaining rotation amount R is less than a threshold rotation amount, the motor 20 is driven at a slow speed. By driving the motor 20 at the slow speed, noise can be suppressed. Further, since the remaining rotation amount R is small, even in the motor 20 is driven at the slow speed, the rotation number will reach the target rotation number soon, and it is less possible that start of printing is delayed.

Figures 4A, 4B:
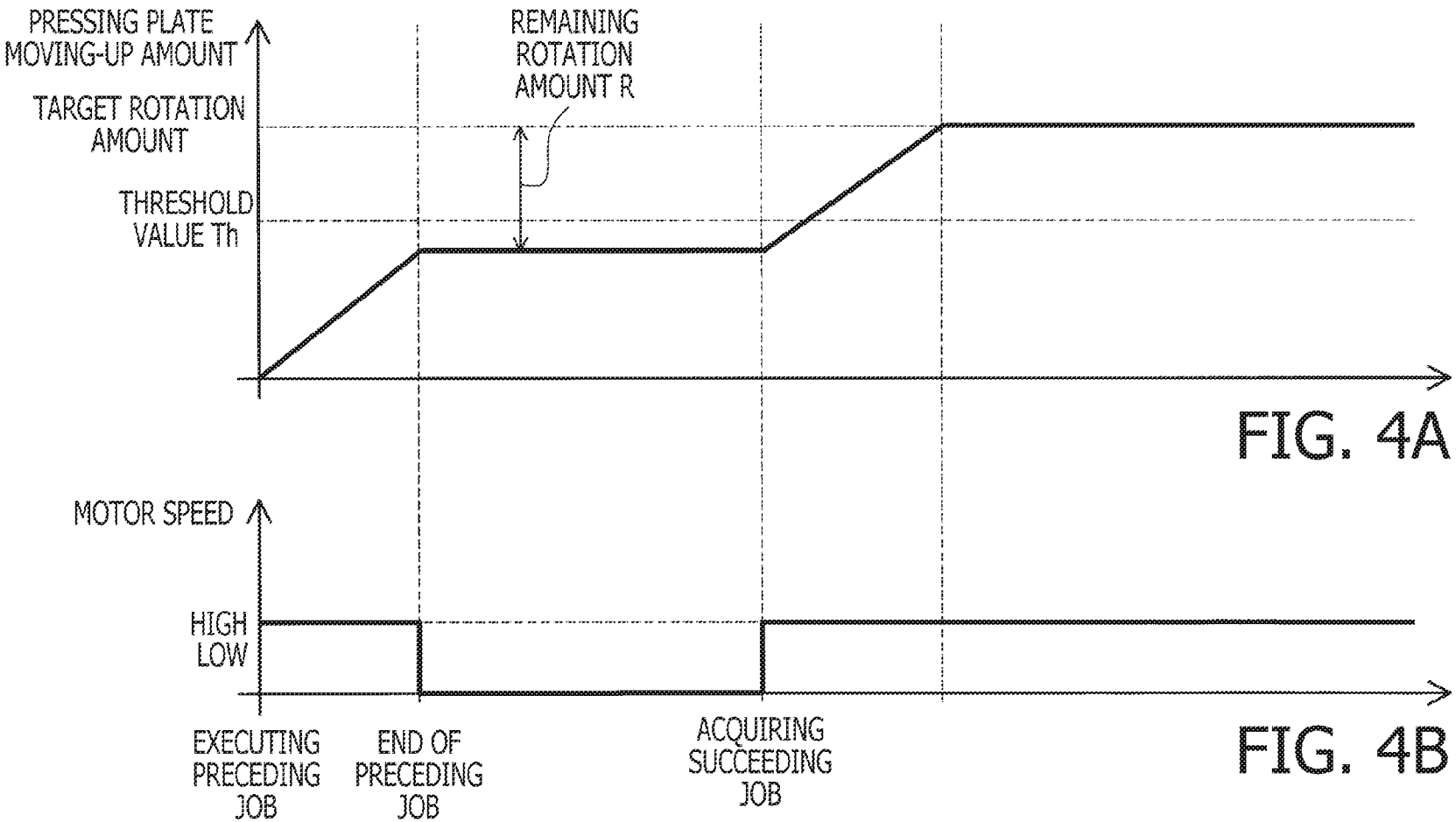
FIGS. 4A and 4B show a relationship between a position of a pressing plate and a speed of a motor when the position of the pressing plate is relatively high according to the illustrative embodiment of the disclosures.

As shown in FIG. 4, the rotation amount of the motor 20 after the main body tray 91 is attached to the printer 100 is smaller than the threshold value Th. Thus, when the remaining rotation amount R is greater than the threshold rotation amount, the motor 20 is driven at a high speed similar to a case where the pressing plate 911 is located at the placing position. That is, suppressing of delay of starting time is prioritized.

According to the illustrative embodiment, as operation modes before printing is executed, the printer 100 has three operation modes which are a pressing plate lifting priority mode, a fixing device high temperature mode and a fixing device low temperature mode.

The printer 100 executes preheating of the fixing device 8 as a preparation operation before executing printing, besides moving of the pressing plate 911 to the conveying position. A time period necessary for the preheating varies depending on whether the temperature of the fixing roller 81 of the fixing device 8 is higher than a particular temperature or not at the time of starting the preparation operation. That is, when the temperature of the fixing roller 81 is higher than the particular temperature, the time period for preheating is short. Therefore, according to the illustrative embodiment, it is assumed that the time period necessary for the preheating when the temperature of the fixing roller 81 is high is 0.5 seconds. It is also assumed that a time period necessary for rotating the motor 20 by twenty revolutions at the high speed is 0.5 seconds. Further, it is assumed that the time period necessary for the preheating is 5.0 seconds when temperature of the fixing roller 81 is lower than the particular temperature. Further, it is also assumed that a time period necessary for rotating the motor 20 by 250 revolutions is 5.0 seconds.

The motor 20 is rotated during the period necessary for the preheating. It is noted that the particular temperature can be arbitrarily set. However, the particular temperature should be lower than the temperature when the fixing device 8 operates, and higher than the room temperature. It is noted that the temperature of the fixing roller 81 is referred to in the above description, the temperature referred to need not be limited to the temperature of the fixing roller 81. For example, as an alternative, an inside temperature of the image forming apparatus measured by a sensor arranged in the vicinity of the fixing device.

When the temperature of the fixing roller 81 is lower than the particular temperature, an extra load may be generated since viscosity of grease used for the fixing roller 81 increase. Therefore, it is preferable that the fixing roller 81 is rotated at the low speed until the temperature increases and the viscosity of the grease lowers. According to the illustrative embodiment, it is assumed that a time period for rotating the motor 20 by 100 revolutions at the low speed is 5.0 seconds.

Therefore, in the fixing device high temperature mode, which is the operation mode when the temperature of the fixing roller 81 is higher than the particular temperature, the motor 20 is rotated at the high speed with the target rotation amount is 20 revolutions.

When the pressing plate 911 does not reach the conveying position during the preheating operation, that is, when the temperature of the fixing roller 81 is high and the remaining rotation amount is 20 revolutions or more, or when the temperature of the fixing roller 81 is low and the remaining rotation amount is more than 100 revolutions, the printer 100 operates in the pressing plate lifting priority mode, and rotates the motor 20 at the high speed with the target rotation amount is 250 revolutions.

Figure 5:
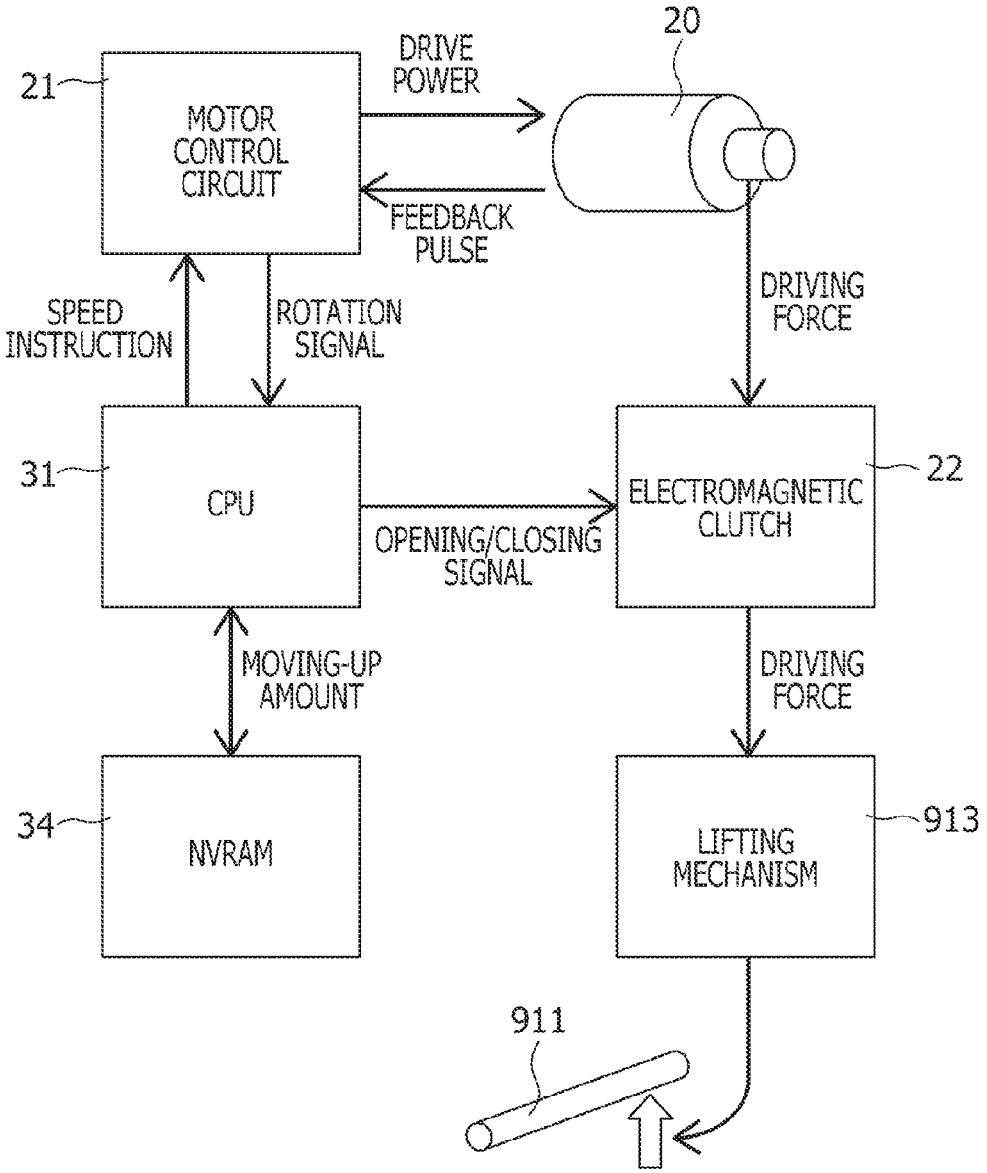
FIG. 5 is a block diagram illustrating a relationship between the motor and a motor control circuit according to the illustrative embodiment of the disclosures.

It is note that the rotation amount of the motor 20 is obtained based on an FG (frequency generator) pulse signal of the motor 20 or a feedback pulse output by an encoder. According to the illustrative embodiment, as shown in FIG. 5, a speed instruction is transmitted from the CPU 31 to the motor control circuit 21. Then, the motor control circuit 21 supplies driving electrical power corresponding to the speed instruction to the motor 20. Then, the motor 20 rotates, the driving force is transmitted to the lifting mechanism 913 via the electromagnetic clutch 22, and the pressing plate 911 moves up. It is noted that the electromagnetic clutch 22 connects/disconnects the driving force from the motor 20 in accordance with the open/close signal output by the CPU 31. The CPU 31 keeps the electromagnetic clutch 22 in the connecting state at least when the pressing plate 911 has not reached the conveying position.

The motor control circuit 21 receives the FG pulse signal of the motor 20 or the feedback pulse signal from the encoder, and transmits the rotation signal based on the received pulse signal to the CPU 31. That is, the CPU 31 receives the rotation signal which indicates one revolution of the motor 20 by a particular number of pulses. Then, the CPU 31 counts the number of pulses of the rotation signal when the electromagnetic clutch 22 is in the connecting state. Thereafter, the CPU 31 stores a lifted amount of the pressing plate 911, which is obtained based on the counted number, in the NVRAM 34.

<Starting Process>

Figure 6:
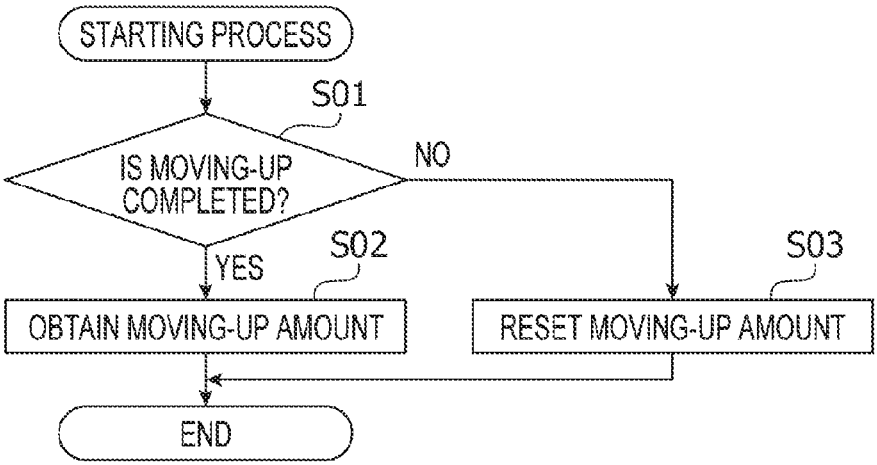
FIG. 6 is a flowchart illustrating a starting process executed in the printer according to the illustrative embodiment of the disclosures.

Hereinafter, processes for realizing the lifting control of the pressing plate 911 will be described. Firstly, referring to FIG. 6, a starting process will be described. The starting process is executed by the CPU 31 of the printer 100 in response to turning on of the printer 100.

In the starting process, the CPU 31 determines whether moving up of the pressing plate 911 has completed (S01). It is noted that the CPU 31 is capable of determining whether the moving up of the pressing plate 911 has completed based on, for example, whether the pressing plate sensor 61 outputs a signal indicating the pressing plate 911 is located at the conveying position. The pressing plate 911 is in a state where the moving up of the pressing plate 911 has not completed when, for example, the main body tray 91 is detached from the printer 100 when the printer 100 is powered off, or when the pressing plate 911 had not reached the conveying position when the printer 100 was powered off.

When it is determined that the moving up of the pressing plate 911 has completed (S01: YES), the CPU retrieves the lifting amount of the pressing plate 911 from the NVRAM 34 (S02). The CPU 31 has stored the rotation amount of the motor 29 used to move up the pressing plate 911 after the main body tray 91 as attached to the main body of the printer 100 as the moving-up amount. When it is determined that the moving-up of the pressing plate 911 has not completed (S01: NO), the CPU 31 rests the lifting amount to zero (S03). After execution of S02 or S03, the CPU 31 terminates the starting process.

<Rotation Amount Storing Process>

Figure 7:
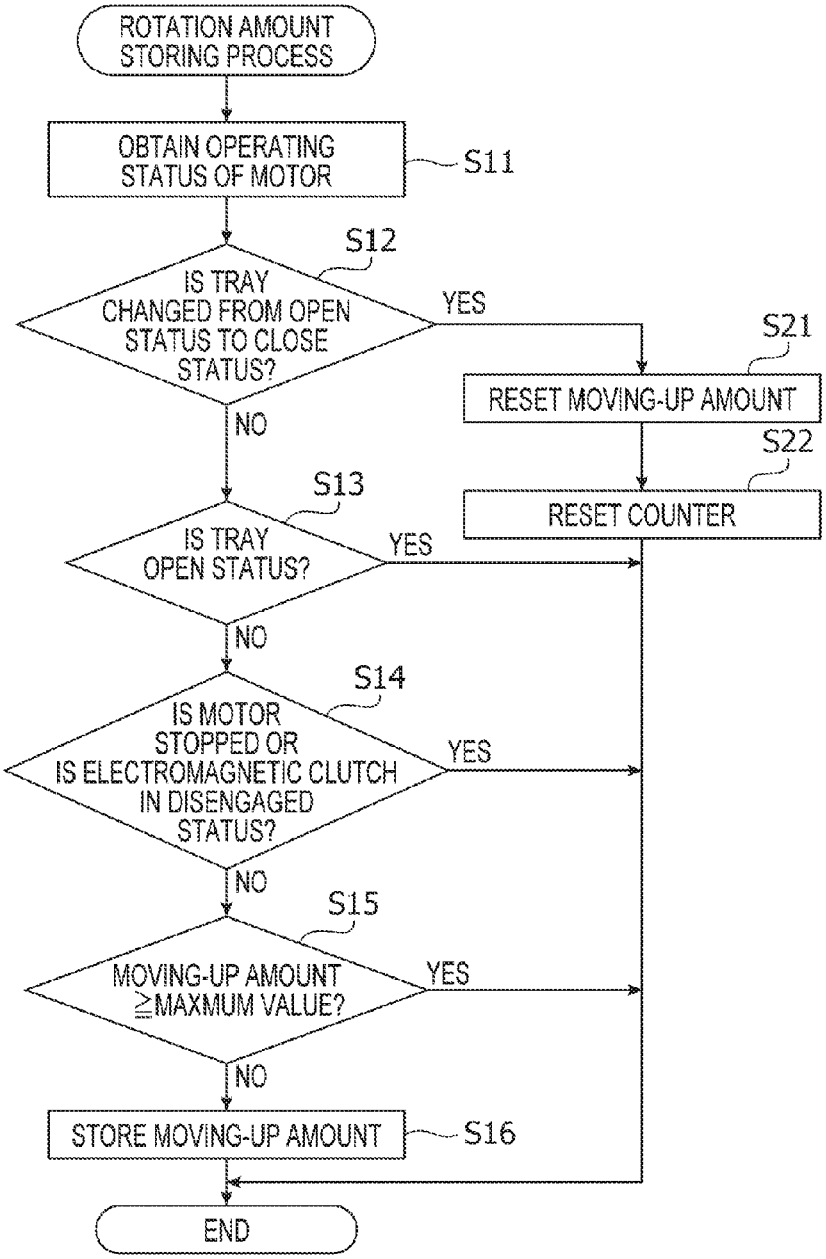
FIG. 7 is a flowchart illustrating a rotation amount storing process according to the illustrative embodiment of the disclosures.

FIG. 7 is a flowchart showing a rotation amount storing process in which the rotation amount of the motor 20 after the main body tray 91 is attached to the printer is stored. The rotation amount storing process is repeatedly executed at every 100 ms (milliseconds) by the CPU 31 of the printer 100. It is noted that the rotation amount storing process may be executed temporarily using the RAM 33, and the data stored in the RAM 33 may be transferred to the NVRAM 34 at a timing, for example, when the motor 20 is stopped.

In the rotation amount storing process, the CPU 31 obtains the operation status of the motor 20 (S11). The operation status of the motor 20 includes rotating at the high speed, rotating at the low speed and the stopped.

After execution of S11, the CPU 31 determines whether the status of the main body tray 91 is changed from the open status to the close status (S12). It is noted that the CPU 31 is capable of determining whether the main body tray 91 is in the open status or close status based on the signal output by the tray sensor 62.

When the status of the main body tray 91 is changed from the open status to the close status (S12: YES), since the main body tray 91 was in the open status, the pressing plate 911 is returned to the placing position and the CPU 31 resets the lifting amount to zero (S21). Further, the CPU 31 sets the counter used to count the number of pulses of the rotation signal when the electromagnetic clutch 22 is connected to zero (S22). After execution of S22, the CPU 31 terminates the rotation amount storing process.

When it is determined that the status of the main body tray is not changed from the open status to the close status (S12: NO), the CPU 31 determines whether the main body tray 91 is in the open status (S13). When the main body tray 91 is in the open status (S13: YES), the CPU 31 terminates the rotation amount storing process.

When the main body tray 91 is in the close status (S13: NO), the CPU 31 determines whether the motor 20 is stopped or the electromagnetic clutch is in the disconnected status (S14). It is noted that the CPU 31 is capable of determining whether the motor 20 is stopped or not based on the operating status obtained in S11. When the motor 20 is stopped or the electromagnetic clutch 22 is disconnected (S14: YES), no driving force is transmitted to the lifting mechanism 913, and there is no need to change the lifting amount. Therefore, in such a case, the CPU 31 terminates the rotation amount storing process.

When the motor 20 is not stopped and the electromagnetic clutch 22 is not disconnected (S14: NO), the CPU 31 determines whether the lifting amount stored in the NVRAM 34 is equal to or greater than its maximum value (S15). The maximum value is the rotation amount of the motor 20 necessary for lifting the pressing plate 911 from the placing position to the conveying position, and according to the illustrative embodiment, the maximum value is assumed to be 200. When the lifting amount is equal to or greater than the maximum value (S15: YES), it is assumed that the pressing plate 911 is located at the conveying position, and the CPU 31 terminates the rotation amount storing process.

When the lifting amount is less than the maximum value (S15: NO), the CPU 31 calculates the rotation amount of the motor 29 based on the counter value of the counter which counts the number of pulses of the rotation signal when the electromagnetic clutch 22 is in the connected status, and stores the calculated rotation amount as the lifting amount of the pressing plate 911 in the NVRAM 34 (S16). It is noted that S16 is an example of a storing process set forth in the claims. After execution of S16, the CPU 31 terminates the rotation amount storing process.

<Mode Determining Process>

Figure 8:
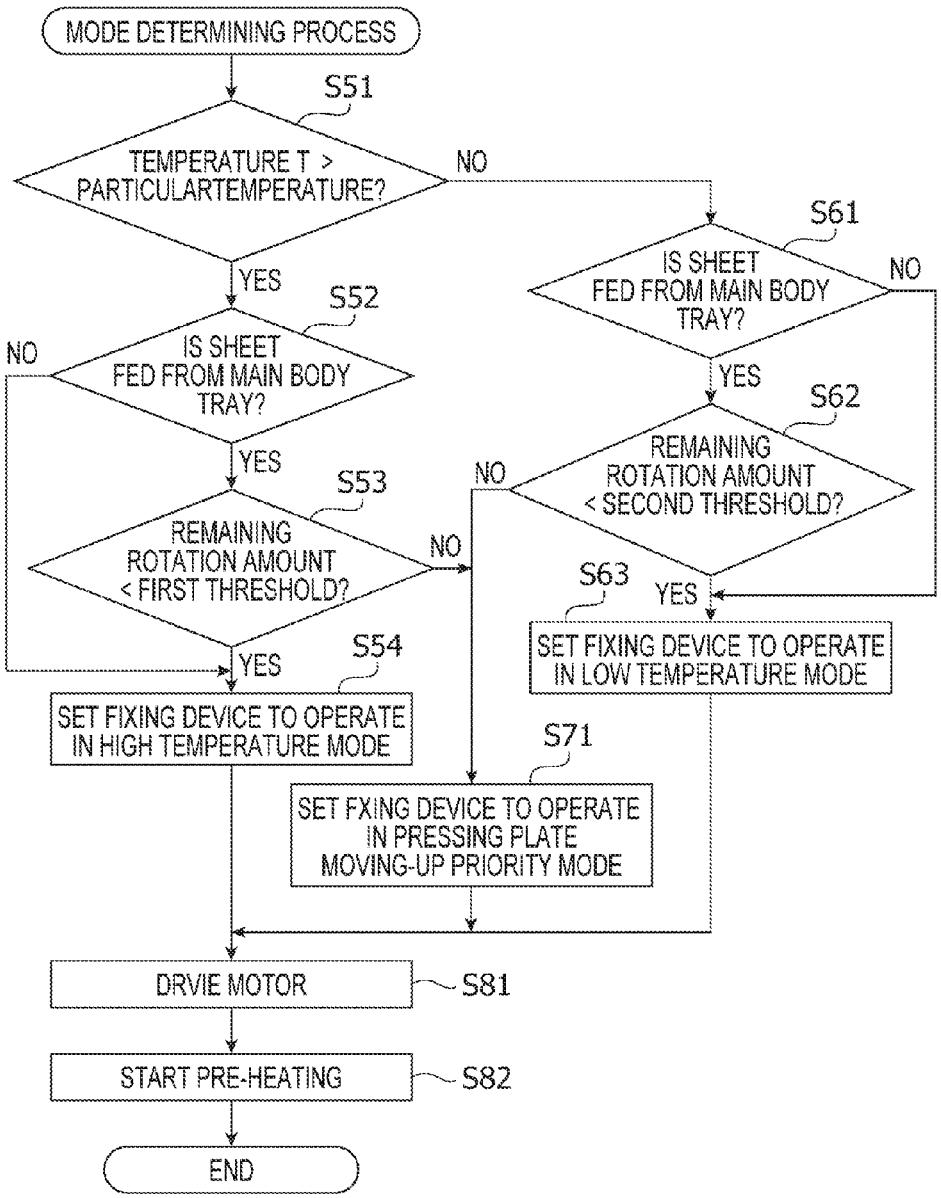
FIG. 8 is a flowchart illustrating a mode determining process according to the illustrative embodiment of the disclosures.

FIG. 8 is a flowchart illustrating a mode determining process. The mode determining process is executed by the CPU 31 in response to receipt of a print instruction.

In the mode determining process, the CPU 31 firstly determines whether the surface temperature T of the fixing roller 81 is higher than a particular temperature (S51). When the temperature sensor 63 outputs the temperature signal indicating that the temperature of the temperature sensor 63 is higher than the particular temperature, the CPU 31 determines that the surface temperature T is higher than the particular temperature.

When the surface temperature T is higher than the particular temperature (S51: YES), the CPU 31 determines whether the print instruction includes an instruction to feed the printing sheets from the main body tray 91 (S52). When the print instruction does not include an instruction to feed the printing sheets from the main body tray 51 (S52: NO), that is, when the printing sheets are to be fed from the MP tray 93, the CPU 31 sets the operation mode to the fixing device high temperature mode (S54) since the MP tray 93 does not have the pressing plate and it is unnecessary to move the pressing plate 911 of the main body tray 91. It is noted that the motor 20 rotates as the fixing device high temperature mode, the pressing plate 911 moves up by the rotation of the motor without executing a particular process to moving up the pressing plate 911.

When the instruction is to feed the printing sheets from the main body tray 91 (S52: YES), the CPU 31 determines whether the remaining rotation amount of the motor 20 to move up the pressing plate 911 to the conveying position is less than a first threshold value (S53). According to the illustrative embodiment, the remaining rotation amount of the motor 20 to move the pressing plate 911 up to the conveying position is a difference between the rotation amount necessary to move up the pressing plate 911 from the placing position to the conveying position (e.g., 200 revolutions) and the rotation amount of the motor 20 corresponding to the lifting amount and stored in the NVRAM 34. The first threshold value is the rotation amount at which the motor 20 rotates during the time period corresponding to the preheating of the fixing device 8 at the high temperature (e.g., 20 revolutions).

When it is determined that the remaining rotation amount is less than the first threshold value (S53: YES), the CPU 31 determines that the operation mode is the fixing device high temperature mode (S54) since it is possible to move up the pressing plate 911 to the conveying position by the rotation amount of the motor 20 in association with the preparation operation of the fixing device 8.

When the remaining rotation amount is less than the first threshold value (S53: NO), the CPU 31 sets the operation mode to the pressing plate lifting priority mode (S71) since the pressing plate 911 cannot be moved up to the conveying position by the moving amount of the motor 20 in association with the preparation operation of the fixing device 8.

When the surface temperature T is not higher than the particular temperature (S51: NO), the CPU 31 determines whether the print instruction requires feeding of the printing sheets from the main body tray 91 (S61). when it is determined that the instruction does not require the printing sheets fed from the main body tray 91 (S61: NO), that is, the instruction requires to feed the printing sheets from the MP tray 93, the CPU 31 determines the fixing device low temperature mode (S63) since it is unnecessary to move the pressing plate 911.

When the print instruction includes a request to feed the printing sheets from the main body tray 91 (S61: YES), the CPU 31 determines whether a remaining rotation amount of the motor 20 to move up the pressing plate 911 to the conveying position is less than a second threshold value (S62). The second threshold value is the rotation amount at which the motor 20 can rotates at the low speed within the time period necessary for preheating the fixing device 8 to the low temperature (e.g., 100 revolutions).

When the remaining rotation amount is less than the second threshold value (S62: YES), the CPU 31 determines the operation mode as the fixing device low temperature mode (S63) since the pressing plate 911 can be moved up to the conveying position by the rotation amount of the motor 20 in association with the preparation operation of the fixing device 8.

When the remaining rotation amount is not less than the second threshold value (S62: NO), the CPU 31 determines the operation mode to the pressing plate lifting priority mode (S71) since the pressing plate 911 cannot be moved up to the conveying position by the rotation amount of the motor 20 in association with the preparation operation of the fixing device 8. It is noted that a process in steps S62 onwards is a moving process set forth in the claims.

After execution of S54, S63 or S71, the CPU 31 operates the motor 20 in accordance with the determined operation mode (S81). That is, when the determined operation mode is the fixing device high temperature mode, the CPU 31 operates the motor 20 at the high speed with the target rotation amount being 20 revolutions. When the operation mode is the fixing device low temperature mode, the CPU 31 operates the motor 20 at the low speed mode with the target rotation amount being 100 revolutions. When the operation mode is pressing plate lifting priority mode, the CPU 31 operates the motor 20 at the high speed with the target rotation amount being 250 revolutions. Further, the CPU 31 starts preheating of the fixing roller 81 of the fixing device 8 (S82). It is noted that S82 is an example of a preheating process set forth in the claims. After execution of S82, the CPU 31 stops the mode determining process.

As described in detail above, the motor 20 is mechanically connected to the processing device 50 and the fixing device 8 as well as the pressing plate 911. Therefore, not only when printing is executed by feeding the printing sheets from the main body tray 91, but when the printing sheets are fed from the MP tray 93 or when printing is not executed (e.g., when an image compensation operation or a cleaning operation is executed), the motor 20 is rotated. That is, at a very first feeding operation after the main body tray 91 is attached to the printer 100, the pressing plate may already have been moved up to an intermediate position between the placing position and the conveying position. Since the pressing plate 911 can be moved up to the conveying position even if the motor 20 is rotated at the slow speed if the remaining rotation amount is small, the motor 20 is rotated at the slow speed to suppress noises. In contrast, when the remaining rotation amount is large, the motor 20 is rotated at the high speed so that delay of start of printing is suppressed. As above, according to the illustrative embodiment, it is expected that reduction of noise and suppression of delay of start of printing are balanced.

According to the illustrative embodiment, when the pressing plate 911 reaches the conveying position during the preheating operation as in the fixing device high temperature mode or the fixing device low temperature mode, the motor 20 is controlled not to rotate exceeding the necessary rotation amount during the preheating operation. According to such a configuration, since the rotation amount of the motor 20 can be suppressed, consumption of the rotating members (e.g., the photosensitive member 1) mechanically connected to the motor 20 can be suppressed. Further, since the rotation amount of the agitator 34 can be suppressed, deterioration of the toner can also be suppressed.

It is noted that the above-described embodiment is only an illustrative embodiment, which is not intended to limit the scope of the disclosures. Rather, the scope of the present disclosures could be modified in various ways without departing aspects of the disclosures. For example, the image forming apparatus is not limited to the printer but can be any apparatus provided with a printing function and can be a copier, a facsimile machine, an MFP (multi-function peripheral) and the like.

According to the illustrative embodiment, the rotation amount of the motor 20 is obtained based on the rotation signal output by the motor control circuit 21. It is noted that the rotation amount of the motor, or the lifting amount of the pressing plate 911 may be obtained in other ways. For example, the rotation amount of the motor 20 may be calculated based on the driving period and the rotating speed of the motor 20 referring to the signal transmitted from the CPU 31 to the motor control circuit 21. It is noted that a method of obtaining the rotation amount of the motor 20 based on the rotation signal output by the motor control circuit 21 as in the illustrative embodiment is more accurate than a method of calculating the rotation amount of the motor 20 based on the driving period and the driving speed of the motor 20, and therefore a control based on the more accurate rotation amount can be expected according to the latter former method.

Figure 9:
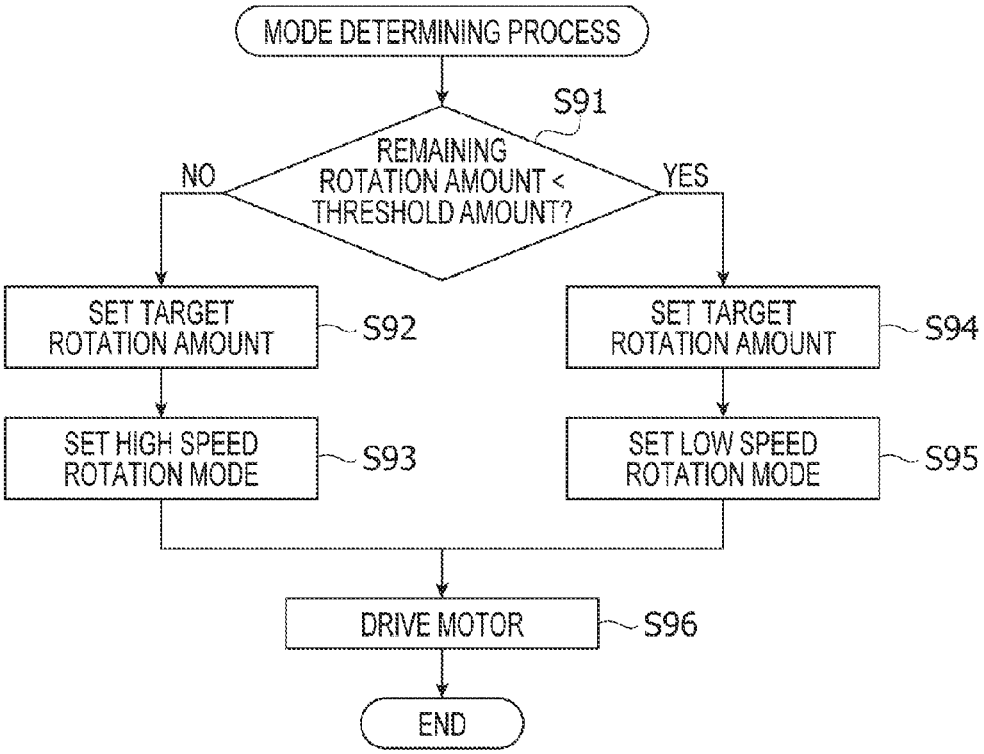
FIG. 9 is a flowchart illustrating a mode determining process according to a modified embodiment of the disclosures.

According to the illustrative embodiment, the operation mode is determined based on the surface temperature of the fixing roller 81 of the fixing device 8. However, the operation mode of the motor 20 may be determined without referring to the surface temperature of the fixing roller 81. For example, as shown in FIG. 9, a threshold rotation amount is defined such that the threshold rotation amount is smaller than the rotation amount necessary to move up the pressing plate 911 from the placing position to the conveying position, and when the remaining rotation amount based on the lifted amount is equal to or greater than the threshold rotation amount (S91: NO), the target rotation amount is set to the rotation amount to move up the pressing plate 911 from the placing position to the conveying position (S92) and the rotation speed of the motor 20 is determined to be the high speed (S93), while, when the remaining amount is less than the threshold rotation amount (S91: YES), the target rotation amount is set to the threshold rotation amount (S94) and the rotation speed of the motor 20 is determined to be the slow speed (S95). Then, the motor 20 is controlled to rotate at the determined speed (S96).

According to the illustrative embodiment, the driving force of the motor 20 is transmitted to the pressing plate 911 via the electromagnetic clutch 22. The configuration may be modified such that the electromagnetic clutch 22 is not provided and the motor 20 is directly connected to the pressing plate 91. In such a case, the counter may count the number of pulses of the rotation signal of the motor 20.

According to the illustrative embodiment, the printer 100 is provided with two sheet feed trays 91 and 93. The number of the trays needs not be limited to two, but three or more trays may be provided to the printer 100. For example, an additional tray of which structure is similar to the main body tray 91 may be provided below the main body tray 91, and an electromagnetic clutch which connects/disconnects the driving force from the motor 20 may be provided to the additional tray. In such a case, the printer 100 may be configured to store the lifting amounts of the pressing plates for respective trays (i.e., the main body tray and the additional tray) in the NVRAM 34, and the lifting amounts of the pressing plates when the driving force of the motor 20 is transmitted to the respective trays may be stored. When a print instruction using the additional tray is received, it is unnecessary to move the pressing plate of the main body tray 91, while, when a print instruction using the main body tray is received, it is unnecessary to move the pressing plat of the additional tray.

It is noted that the processes described above may be executed by a single CPU, multiple CPU's, one or more ASIC's (application specific integrated circuit), or a combination thereof. It is also noted that the processed described above may be realized in the form of computer-readable medium storing programs to be executed by a computer, in the form of methods, or the like.

What is claimed is:

1. An electrophotographic image forming apparatus comprising:

a motor;

an image forming device configured to form an image on a printing sheet, the image forming device using a driving force transmitted from the motor;

a fixing device configure to fix the image formed on the printing sheet;

a tray configured to accommodate multiple printing sheets to be conveyed toward the image forming device, the tray being detachably attached to a main body of the image forming apparatus;

a pressing plate configured to move up, with use of a driving force of the motor, the printing sheets accommodated in the tray to a conveying position;

a storage device; and a controller, wherein the motor is configured to operable in a first mode in which the motor rotates at a first speed and a second mode in which the motor rotate at a second speed which is slower than the first speed, wherein the controller is configured to execute:

a storing process in which the controller stores a rotation amount of the motor since the tray is attached to the main body as a stored rotation amount;

a moving process in which the controller moves, in response to receipt of a print instruction, the pressing plate by driving the motor such that:

the controller drives the motor in the first mode when a remaining rotation amount is equal to or larger than a particular threshold rotation amount, the remaining rotation amount being a difference between a target rotation amount, which is a rotation amount necessary to move the pressing plate from a position when the tray is attached to the main body to the conveying position, and the stored rotation amount, which is stored in the storage device; and the controller drives the motor in the second mode when the remaining rotation amount is less than the particular threshold rotation amount.

2. The electrophotographic image forming apparatus according to claim 1, further comprising a temperature sensor configured to output a temperature signal corresponding to a temperature of the fixing device, wherein the controller is configured to execute:

a preheating process to apply preheating of the fixing device in response to receipt of the print instruction such that:

the controller executes a preheating operation for a first time period when the temperature sensor outputs the temperature signal representing that the temperature of the fixing device is equal to or less than the particular threshold temperature; and the controller executes the preheating operation for a second time period which is shorter than the first time period when the temperature sensor outputs the temperature signal representing that the temperature of the fixing device is higher than the particular threshold temperature; and the moving process in response to receipt of the print instruction with using the rotation amount when the motor is rotated at the second speed for the first time period as the particular threshold rotation amount when the temperature sensor outputs the temperature signal representing that the temperature of the fixing device is higher than the particular threshold temperature, and wherein the controller controls the motor in the first mode when the temperature sensor output the temperature signal representing that the temperature of the fixing device is higher than the particular threshold temperature.

3. The electrophotographic image forming apparatus according to claim 2, wherein, when the temperature sensor outputs the temperature signal representing that the temperature of the fixing device is equal to or lower than the particular threshold temperature, the controller controls to:

rotate the motor by the target rotation amount in the first mode;

rotate the motor by the particular threshold amount in the second mode, wherein, when the temperature sensor outputs the temperature signal representing that the temperature of the fixing device is less than the particular threshold temperature, the controller controls to:

rotate the motor by a second threshold amount which is a rotation amount of the motor when the motor is rotated at the first speed during the second time period, when the remaining rotation amount is less than the second threshold rotation amount; and rotate the motor by the target rotation amount when the remaining rotation amount is equal to or greater than the second threshold rotation amount.

4. The electrophotographic image forming apparatus according to claim 1, further comprising a tray sensor configured to output a tray sensor signal representing whether the tray is attached to the main body, wherein the controller resets the stored rotation amount of the motor, which is stored in the storage device in response to the tray sensor outputting the tray sensor signal representing that the tray is not attached to the main body.

5. The electrophotographic image forming apparatus according to claim 1, wherein the image forming device includes:

a toner accommodator configured to accommodate toner; and an agitator configured to agitate the toner accommodated in the toner accommodator with use of the driving force transmitted from the motor.

6. The electrophotographic image forming apparatus according to claim 1, wherein the controller is configured to execute a counting process to count the number of pulses contained in a pulse signal output by the motor, and wherein the controller is configured to store one of the number of pulses counted in the counting process and the rotation amount of the motor calculated from the number of pulses in the storage device in the storing process.

7. The electrophotographic image forming apparatus according to claim 1, further comprising a clutch device configured to electrically connect or disconnect transmission of driving force through a drive array which is configured to transmit the driving force of the motor to the pressing plate, wherein the controller is configured to store the rotation amount of the motor when the clutch is connected in the storage device.

8. The image forming apparatus according to claim 1, further comprising a second tray configured to accommodate the printing sheets to be conveyed to the image forming device, wherein both a roller configured to pick up the printing sheets accommodated in the second tray and a roller configured to pick up the printing sheets accommodated in the tray rotate by the driving force transmitted from the motor, wherein the controller executes the moving process when the print instruction requiring to use the printing sheets stored in the tray is received, while the controller does not execute the moving process when the print instruction requiring to use the printing sheets stored in the second tray is received.

9. A non-transitory computer-readable medium storing instructions to be executed by a controller of an electrophotographic image forming apparatus provided with a motor, an image forming device configured to form an image on a printing sheet, the image forming device using a driving force transmitted from the motor, a fixing device configure to fix the image formed on the printing sheet, a tray configured to accommodate multiple printing sheets to be conveyed toward the image forming device, the tray being detachably attached to a main body of the image forming apparatus, a pressing plate configured to move up, with use of a driving force of the motor, the printing sheets accommodated in the tray to a conveying position, a data storage device, wherein the motor is configured to operable in a first mode in which the motor rotates at a first speed and a second mode in which the motor rotate at a second speed which is slower than the first speed, the instructions, when executed by the controller, cause the image forming apparatus to execute:

a storing process in which the controller stores a rotation amount of the motor since the tray is attached to the main body as a stored rotation amount;

a moving process in which the controller moves, in response to receipt of a print instruction, the pressing plate by driving the motor such that:

the controller drives the motor in the first mode when a remaining rotation amount is equal to or larger than a particular threshold rotation amount, the remaining rotation amount being a difference between a target rotation amount, which is a rotation amount necessary to move the pressing plate from a position when the tray is attached to the main body to the conveying position, and the stored rotation amount, which is stored in the data storage device; and the controller drives the motor in the second mode when the remaining rotation amount is less than the particular threshold rotation amount.

10. The non-transitory computer-readable medium according to claim 9, wherein the instructions further causes the image forming apparatus to execute:

a preheating process to apply preheating of the fixing device in response to receipt of the print instruction such that:

the controller executes a preheating operation for a first time period when a temperature sensor of the fixing device outputs the temperature signal representing that the temperature of the fixing device is equal to or less than the particular threshold temperature; and the controller executes the preheating operation for a second time period which is shorter than the first time period when the temperature sensor outputs the temperature signal representing that the temperature of the fixing device is higher than the particular threshold temperature; and the moving process in response to receipt of the print instruction with using the rotation amount when the motor is rotated at the second speed for the first time period as the particular threshold rotation amount when the temperature sensor outputs the temperature signal representing that the temperature of the fixing device is higher than the particular threshold temperature, and wherein the controller controls the motor in the first mode when the temperature sensor output the temperature signal representing that the temperature of the fixing device is higher than the particular threshold temperature.

11. A method of controlling movement of a pressing plate employed in an electrophotographic image forming apparatus which is provided with a motor, an image forming device configured to form an image on a printing sheet, the image forming device using a driving force transmitted from the motor, a fixing device configure to fix the image formed on the printing sheet, a tray configured to accommodate multiple printing sheets to be conveyed toward the image forming device, the tray being detachably attached to a main body of the image forming apparatus, a pressing plate configured to move up, with use of a driving force of the motor, the printing sheets accommodated in the tray to a conveying position, and a data storage device, the motor being configured to operable in a first mode in which the motor rotates at a first speed and a second mode in which the motor rotate at a second speed which is slower than the first speed, wherein the method comprises:

a storing step to store a rotation amount of the motor since the tray is attached to the main body as a stored rotation amount;

a moving step to move, in response to receipt of a print instruction, the pressing plate by driving the motor:

in the first mode when a remaining rotation amount is equal to or larger than a particular threshold rotation amount, the remaining rotation amount being a difference between a target rotation amount, which is a rotation amount necessary to move the pressing plate from a position when the tray is attached to the main body to the conveying position, and the stored rotation amount, which is stored in the storage device; and in the second mode when the remaining rotation amount is less than the particular threshold rotation amount.

12. The method according to claim 11, wherein the method further comprises:

a preheating step to apply preheating of the fixing device in response to receipt of the print instruction such that:

a preheating operation is executed for a first time period when the temperature sensor, which is configured to output a temperature signal corresponding to a temperature of the fixing device, outputs the temperature signal representing that the temperature of the fixing device is equal to or less than the particular threshold temperature; and the preheating operation is executed for a second time period which is shorter than the first time period when the temperature sensor outputs the temperature signal representing that the temperature of the fixing device is higher than the particular threshold temperature, wherein the method executes the moving step in response to receipt of the print instruction with using the rotation amount when the motor is rotated at the second speed for the first time period as the particular threshold rotation amount when the temperature sensor outputs the temperature signal representing that the temperature of the fixing device is higher than the particular threshold temperature, and wherein the motor is controlled to operate in the first mode when the temperature sensor output the temperature signal representing that the temperature of the fixing device is higher than the particular threshold temperature.

* * * * *